US010851498B2

(12) United States Patent
McKay

(10) Patent No.: US 10,851,498 B2
(45) Date of Patent: Dec. 1, 2020

(54) INCREASED DRAINAGE PERFORMANCE IN PAPERMAKING SYSTEMS USING MICROFIBRILLATED CELLULOSE

(71) Applicant: Solenis Technologies, L.P., Schaffhausen (CH)

(72) Inventor: Jonathan M McKay, Hilliard, OH (US)

(73) Assignee: Solenis Technologies, L.P., Wilmington ( * ) Notice: Subject to any disclaimer, the term of this patent is extended or adjusted under 35 U.S.C. 154(b) by 165 days.

(21) Appl. No.: 15/704,583

(22) Filed: Sep. 14, 2017

(65) Prior Publication Data

US 2018/0080175 A1 Mar. 22, 2018

Related U.S. Application Data

(60) Provisional application No. 62/395,437, filed on Sep. 16, 2016.

(51) Int. Cl.

| | |
|---|---|
| ***D21H 21/10*** | (2006.01) |
| ***D21H 17/68*** | (2006.01) |
| ***D21H 17/34*** | (2006.01) |
| ***D21H 17/45*** | (2006.01) |
| ***D21H 13/02*** | (2006.01) |
| ***D21H 17/00*** | (2006.01) |
| ***D21J 1/00*** | (2006.01) |
| ***D21H 17/36*** | (2006.01) |
| ***D21H 11/18*** | (2006.01) |
| ***D21H 17/56*** | (2006.01) |
| ***D21H 17/37*** | (2006.01) |
| ***D21F 1/82*** | (2006.01) |
| ***D21H 17/35*** | (2006.01) |
| ***D21H 11/20*** | (2006.01) |

(52) U.S. Cl.

CPC ..... *D21H 21/10* (2013.01); *D21F 1/82* (2013.01); *D21H 11/18* (2013.01); *D21H 11/20* (2013.01); *D21H 13/02* (2013.01); *D21H 17/34* (2013.01); *D21H 17/35* (2013.01); *D21H 17/36* (2013.01); *D21H 17/375* (2013.01); *D21H 17/45* (2013.01); *D21H 17/56* (2013.01); *D21H 17/68* (2013.01); *D21H 17/72* (2013.01); *D21H 17/74* (2013.01); *D21J 1/00* (2013.01)

(58) Field of Classification Search

None

See application file for complete search history.

(56) References Cited

U.S. PATENT DOCUMENTS

| | | | | |
|---|---|---|---|---|
| 5,167,766 | A * | 12/1992 | Honig | D21H 21/54 162/164.1 |
| 6,007,679 | A | 12/1999 | Nagarajan et al. | |
| 6,083,348 | A * | 7/2000 | Auhorn | D21F 1/08 162/164.6 |
| 6,602,994 | B1 * | 8/2003 | Cash | A61K 8/027 536/30 |
| 2010/0326615 | A1 | 12/2010 | Lu | |
| 2011/0155339 | A1 * | 6/2011 | Brungardt | D21H 21/18 162/164.6 |
| 2012/0186764 | A1 * | 7/2012 | McKay | D21H 17/375 162/164.6 |
| 2013/0180680 | A1 * | 7/2013 | Axrup | D21H 21/18 162/177 |
| 2014/0216671 | A1 | 8/2014 | Feng et al. | |
| 2014/0216672 | A1 | 8/2014 | Feng et al. | |
| 2016/0032530 | A1 * | 2/2016 | Virtanen | D21H 17/62 162/164.6 |

FOREIGN PATENT DOCUMENTS

| | | | |
|---|---|---|---|
| WO | 0166600 | A1 | 9/2001 |
| WO | 2013089638 | A1 | 6/2013 |
| WO | 2014055780 | A1 | 4/2014 |

OTHER PUBLICATIONS

European Patent Office International Searching Authority, International Search Report and Written Opinion for International Application No. PCT/US2017/051548 dated Jan. 8, 2018.

* cited by examiner

*Primary Examiner* — Dennis R Cordray

(74) *Attorney, Agent, or Firm* — Lorenz & Kopf, LLP

(57) ABSTRACT

A process for the production of paper, board, and cardboard is disclosed. The process results in improved drainage and comprises adding to the wet end of a paper machine (a) microfibrillated cellulose and (b) a coadditive. The coadditive can be one or more of (1) a cationic aqueous dispersion polymer, (2) colloidal silica, (3) bentonite clay and (4) vinylamine-containing polymers or combinations thereof.

11 Claims, No Drawings

INCREASED DRAINAGE PERFORMANCE IN PAPERMAKING SYSTEMS USING MICROFIBRILLATED CELLULOSE

This application claims the benefit of provisional application No. U.S. 62/395,437, filed Sep. 16, 2016, the entire contents of which are hereby incorporated by reference.

FIELD OF THE INVENTION

This invention relates to improved drainage performance in papermaking systems, whereby the drainage performance is enhanced by adding a combination of wet end additives wherein one of the components of the system is microfibrillated cellulose.

BACKGROUND OF THE INVENTION

Increasing the drainage performance of a paper machine is one of the most critical parameters for papermakers. The productivity of a paper machine is frequently determined by the rate of water drainage from a slurry of paper fiber on a forming wire. Specifically, high levels of drainage allow a papermaker to increase the productivity of the mill both in terms of area of paper produced or in tonnage of paper produced, as the machine may run faster, use less steam to remove water at the dry end of operations, or allow the manufacture of heavier basis weights of paper. Because of the importance of drainage in the area of papermaking, the prior art is replete with examples of drainage aid systems.

It is well known that the drainage of a pulp slurry can be enhanced by use of a synthetic acrylamide-containing micropolymers. For instance, WO 2003050152 discloses the use of a hydrophobically associative micropolymer that significantly improves drainage performance.

Colloidal silica, especially in combination of a cationic additive such as cationic starch or other organic flocculants such as cationic or anionic polyacrylamides, is widely used as a drainage system in industry. Such systems are exemplified in U.S. Pat. Nos. 4,338,150 and 5,185,206, and have been frequently improved or modified, as seen by literature citing these two examples.

The combination of both micropolymers and siliceous materials such as colloidal silica or bentonite clay can also be an effective drainage system. U.S. Pat. Nos. 5,167,766 and 5,274,055 are illustrations of such a system.

Different grades of paper frequently have different requirements for a drainage system to be effective. Recycled grades in particular contain large amounts of anionic contaminants that can reduce the effectiveness of some of the aforementioned drainage systems. Popular drainage systems in recycled paper grades include vinylamine-containing polymers and cationic polyacrylamide dispersions. Some representative vinylamine-containing polymeric drainage systems include those disclosed in U.S. Pat. No. 6,132,558, which incorporate bentonite and silica, and U.S. Pat. No. 7,902,312. Cationic polyacrylamide dispersions are typified in disclosures U.S. Pat. Nos. 7,323,510 and 5,938,937. Vinylamine-containing polymers can be used in combination with cationic polyacrylamide dispersions as in US 2011/0155339.

The use of various modified cellulosic polymers as drainage aids include the disclosure in U.S. Pat. No. 6,602,994 relating to the manufacture and use of microfibrillated carboxymethylcellulosic ethers (MF-CMC) to enhance the drainage performance of a pulp slurry.

US 2013/0180679 illustrates that a variety of microfibrillated cellulosics can also improve the removal of water when combined with a cationic additive with a molecular weight of less than 10,000 Daltons.

DESCRIPTION OF THE INVENTION

This invention relates to the use of microfibrillated cellulose in combination with certain coadditives when added to the wet end of a paper machine. These combinations result in improved drainage performance on the paper machine. This improved paper machine performance may increase the productivity of a paper machine and reduce the energy demand of the dry end of the paper machine. Papermaking operations may become more sustainable with use of this invention.

Disclosed is a process for the production of paper, board, and cardboard comprising adding to the wet end of a paper machine (a) microfibrillated cellulose and (b) a coadditive dispersion, wherein the coadditive may comprise one or more of (1) a cationic aqueous dispersion polymer, (2) colloidal silica, (3) bentonite clay, and (4) vinylamine-containing polymer.

The microfibrillated cellulose can have a net anionic charge.

The coadditive can be a cationic aqueous dispersion polymer as described by Fischer et al. (U.S. Pat. No. 7,323,510).

The coadditive can comprises colloidal silica.

The coadditive can comprise bentonite clay.

The coadditive can comprise a vinylamine-containing polymer.

The microfibrillated cellulose and the coadditive can be added to the pulp slurry in a ratio of from 10:1 to 1:10, respectively, in an amount of from 0.01% to 0.25% on a weight basis of the dry pulp, based on the active solids of the two products.

In one preferred embodiment of the process, the coadditive is a cationic aqueous dispersion polymer, the microfibrillated cellulose and coadditive are added to a pulp slurry in a ratio of from 5:1 to 1:2, in an amount of from 0.01% to 0.15% by weight of the combination of the solids of the two products based on the weight of the dry pulp.

Also disclosed is paper product produced by the process of adding to the wet end of a paper machine (a) microfibrillated cellulose and (b) a coadditive, wherein the coadditive may comprise one or more of (1) a cationic aqueous dispersion polymer, (2) colloidal silica, (3) bentonite clay and (4) vinylamine-containing polymer.

We have discovered that the use of microfibrillar cellulose in conjunction with certain other coadditives gives a surprising enhancement of drainage performance. Using one or more coadditives from a selection that includes bentonite, colloidal silica, cationic dispersion polymers, or vinylamine-containing polymers has been shown to produce this unexpected result.

Microfibrillar cellulose has been well-described in the literature. By using cellulose from diverse sources such as wood pulp or cotton linters and applying a significant amount of shear to an aqueous suspension of the cellulose, some of the crystalline portions of the cellulosic fiber structure are fibrillated.

Some of the methods known to produce such fibrillation include grinding, sonication, and homogenization. Of these methods, homogenization is the most practical for use at a manufacturing site or in a paper mill, as it requires the least amount of energy.

The fiber source of the cellulose also has a great impact on the susceptibility of the cellulose fiber to be fibrillated and on the stability of the microfibrillated cellulose dispersion. Wood pulp and cotton linters are preferred as the primary source of cellulose. More preferably, cotton linters are the primary source of cellulose. Without wishing to be bound by theory, cotton linters generally contain a higher purity and higher molecular weight of cellulose in the fiber, and these factors make cellulose derived from cotton linters more susceptible to the shear forces applied. Cellulose derived from wood pulp can also be an acceptable in forming a microfibrillar cellulose dispersion, but it is preferable that the wood pulp be subjected to the kraft pulping process to remove lignin and other impurities detrimental to the shearing process. Moreover, it is preferable that the wood pulp be derived from softwood trees, as softwood fibers are generally of a higher molecular weight. Without wishing to be bound by theory, pulp derived from hardwood species and especially recycled pulp have fibers that are shorter and are thus generally of a lower molecular weight that will not generate a stable microfibrillated suspension when subjected to shear.

Cellulosic fibers can be derivatized to give the fiber an overall charge. Without wishing to be bound by theory, cellulose that has been derivatized to give an overall charge, whether cationic or anionic, requires less energy to shear and is thus more susceptible to microfibrillation, as the electrostatic repulsion between similarly-charged moieties on a given fiber create disruptions in the crystallinity of those portions of the fiber.

A cationic charge is most readily generated by treating a cellulosic fiber with a reactive cationic reagent. Reactive cationic reagents may include 2-dimethylamino ethyl chloride, 2-diethylamino ethyl chloride, 3-dimethylamino propyl chloride, 3-diethylamino propyl chloride, 3-chloro-2-hydroxypropyl trimethylammonium chloride; most preferably 3-chloro-2-hydroxypropyl trimethylammonium chloride.

An anionic charge is readily generated by directly oxidizing cellulose. This oxidation generally takes place at the C-6 position of the B-anhydroglucose unit of a cellulosic polymer. These oxidizing agents can be soluble in water or in organic solvents, most preferably in water. Oxidizing agents that may be useful include N-oxides such as TEMPO or others. Such direct oxidation may be preferable in that anionic cellulose can be efficiently made.

Anionic charge can also be generated by reaction of a cellulose suspension with such derivitizing agents such as chloroacetic acid, dichloroacetic acid, bromoacetic acid, dibromoacetic acid, as well as salts thereof. Chloroacetic acid is the preferable anionic derivitizing agent. Methods for the production of such carboxymethylated cellulose (CMC) are described in the literature as in U.S. Pat. No. 6,602,994 and are incorporated here by reference.

The degree of derivitization of the cellulose is a critical factor in its ability to form a stable microfibrillated dispersion. The degree of functionalization of the cellulose is referred to the degree of substitution (DS) and is described by the average number of functionalizations per B-anhydroglucose unit of a cellulose chain. The methods for its determination are also described in U.S. Pat. No. 6,602,994. The DS of cellulose useful in this invention is in the range of from 0.02-0.50, or from 0.03 to 0.50, more preferably of from 0.03-0.40, or from 0.05 to 0.40, or from 0.05-0.35 or from 0.10-0.35. Without wishing to be bound by theory, a DS value below this range provides insufficient density of functionalization to enhance the susceptibility of the cellulose to shear. On the other hand, a DS value above this range renders the cellulose mostly or entirely water soluble, and thus a microfibrillated dispersion cannot be made as the material is water soluble. Cellulose with a DS above this point are not effective in generating drainage performance as described by this invention.

In the derivitization step of the cellulose, it can be effective to treat the cellulose with a base, such as sodium hydroxide, prior to the addition of the derivitization agent. Without wishing to be bound by theory, treatment of the cellulose with a base causes the fiber bundles to swell. This in turn exposes parts of the fiber that may be functionalized. The time, temperature, and amount of base used can all affect the functionalization and subsequent susceptibility of the cellulose to shear.

The microparticle suspension used in conjunction with the microfibrillar cellulose is of great importance. We have found that the microparticle dispersion is most effective if it comprises at least one of (1) colloidal silica, (2) bentonite, (3) cationic dispersion polymer, or (4) vinylamine-containing polymer.

Colloidal silica has long been recognized as an effective drainage aid when used in conjunction with a cationic agent such as cationic starch. Indeed, the use of colloidal silica in conjunction with cationic starch as first reported in U.S. Pat. No. 4,388,150 remains one of the most popular drainage and retention systems used in papermaking today. The methods of producing colloidal silica and some of the more recent improvements in its production and structure are known in the prior art, such as U.S. Pat. Nos. 6,893,538 and 7,691,234. Such dispersions of colloidal silica may be useful in the present invention.

Bentonite clay is also useful in the present invention when used in conjunction with microfibrillar cellulose. Characteristic properties of bentonite clay such as is useful for retention and drainage and papermaking systems can be found in the prior art, such as US 2006/0142429.

Cationic aqueous dispersion polymers are one preferred coadditive useful in the present invention. Useful so-called "water-in-water" dispersions have been described in the prior art, as in Fischer et al. (U.S. Pat. No. 7,323,510) as well as recent patent applications by Brungardt et al., (US 2011/0155339) and McKay et al. (US 2012/0186764). These dispersions do not contain high levels of inorganic salt and is therefore distinct from the brine dispersions. Insofar as a salt is used in manufacturing the water-in-water polymer dispersion, salt is added in quantities of less than 2.0% by weight, preferably in quantities of between 0.5 to 1.5% by weight, referred to the total dispersion. In this context, the quantities of added water-soluble acid and possibly added water-soluble salt should preferably amount to less than 3.5% by weight referred to the total dispersion.

Cationic aqueous dispersion polymers, where the dispersion has a high inorganic salt content, are also useful in the present invention, such as those disclosed in U.S. Pat. No. 5,938,937, for example. Such dispersions are commonly referred to as "brine dispersions." Prior art referred to in U.S. Pat. No. 5,938,937, as well as art referencing U.S. Pat. No. 5,938,937, teaches that various combinations of low molecular weight highly cationic dispersion polymers and elevated inorganic salt content can be effective in producing a cationic aqueous dispersion polymer. Such dispersions would also be useful in the present invention. However, the high inorganic salt content of these products increases conductivity in papermaking systems with closed water loops. Because these inorganic salts are not retained in the paper and instead are recirculated in the whitewater, conductivity gradually increases. As the conductivity increases, it is well-known that the effectiveness of many chemistries decreases. Without wishing to be bound by theory, the use of such brine dispersions over time will require the addition of significant amounts of freshwater, thereby reducing the sustainability of papermaking operations.

Also of particular note is the composition of the preferred "water-in-water" cationic aqueous dispersion polymers. As disclosed in the referenced prior art, a polymer of that type is composed generally of two different polymers: (1) A highly cationic dispersant polymer of a relatively lower molecular weight ("dispersant polymer"), and (2) a cationic polymer of a relatively higher molecular weight that forms a discrete particle phase when synthesized under particular conditions ("discrete phase"). Preferably the cationic polymer of a relatively higher weight is a cationic polyacrylamide co polymer. The dispersant polymer of the cationic aqueous dispersion polymer is most effective when made as a homopolymer of a cationic monomer. The average molecular weight, $M_W$ of the (low molecular weight) dispersant polymer is in the range of from 10,000 to 150,000 Daltons, more preferably of from 20,000 to 100,000 Daltons, most preferably of from 30,000 to 80,000 Daltons. These cationic aqueous dispersion polymers may have molecular weights of from 300,000 Daltons to 1,500,000 Daltons, or from 400,000 Daltons to less than 1,250,000 Daltons, while maintaining polymer solids content of from 10% to 50% on a weight basis. Without wishing to be bound by theory, a molecular weight below these ranges creates a more significant negative impact on the drainage performance of the final product. Furthermore, dispersant polymers (low molecular weight) with a molecular weight below 10,000 Daltons (such as those used in conjunction with microfibrillated cellulose as described in US 2013/0180679) would not be retained well. Not only might poor retention of such a low molecular entity cause similar conductivity problems as the brine dispersions described above, but such cationic polymers, if unretained, present potential problems for the ecology as they are known to be harmful to aquatic and marine life. If retained in the paper, such low molecular weight polymers may come in contact with and migrate into aqueous and fatty substances such as food where they may present health hazards to humans, especially when used in packaging grades of paper. Thus, the use of low molecular weight cationic polymers (as described in US2013/0180679) when used in conjunction with microfibrillated cellulose may negatively affect the sustainability of papermaking operations.

One method for estimating the size of the cationic aqueous dispersion-type polymer in solution is by reduced specific viscosity (RSV). Larger RSV values indicate larger molecular size in solution and is measured on a polymer solids basis. Larger size of cationic aqueous dispersion-type polymer in solution leads to better performance when used as a coadditive in the present invention. A cationic aqueous dispersion-type polymer of the present invention has an RSV value of greater than 3.0 dL/g, more preferably greater than 4.0 dL/g, most preferably greater than 5.0 dL/g.

Vinylamine-containing polymers are known in the prior art. Examples of useful vinylamine-containing polymers are described in US 2011/0155339 which is incorporated herein for reference.

The vinylamine-containing polymer can have a molecular weight of from 75,000 Daltons to 750,000 Daltons, more preferably of from 100,000 Daltons to 600,000 Daltons, most preferably of from 150,000 Daltons to 500,000 Daltons. The molecular weight can be from 150,000 Daltons to 400,000 Daltons. An aqueous solution vinylamine-containing polymer above 750,000 Daltons either is typically made at such high viscosities as to render product handling extremely difficult, or alternatively is made in such low product polymer solids as to render the product not cost effective to store and ship.

The vinylamine-containing polymer can be an N-vinylformamide homopolymer that has been fully or partially hydrolyzed to vinylamine. Preferably the vinylamine containing polymer has an N-vinylformamide charge of from at least 50% to 100%, preferably from 75 to 100%, with a range of hydrolysis of from 30% to 100% or from 50 to 100% or from 30 to 75%.

The active polymer solids percentage of the vinylamine-containing polymer ranges of from 5% to 30%, more preferably from 8% to 20% by weight of the total vinylamine-containing polymer product content. Below 5% active polymer solids, higher molecular weight aqueous solution polymers may be possible, but the product becomes ineffective with respect when shipping and transportation costs are accounted for. On the other hand, as the active polymer solids rises, the molecular weight of the polymer must decrease overall so that the aqueous solution is still easily pumpable.

The performance of the vinylamine-containing polymer is influenced by the amount of primary amine present in the product. The vinylamine moiety is typically generated by acidic or basic hydrolysis of N-vinylacrylamide groups, such as N-vinylformamide, N-vinylacetamide, or N-vinyl propionamide, most preferably N-vinylformamide. After hydrolysis, at least 10% of the N-vinylformamide originally incorporated into the resultant polymer should be hydrolyzed. Without wishing to be bound by theory, the hydrolyzed N-vinylformamide group may exist in various structures in the final polymer product such as primary or substituted amine, amidine, guanidine, or amide structures, either in open chain or cyclical forms after hydrolysis.

Microfibrillated cellulose and the coadditive should be added to the wet end of the paper machine to achieve drainage performance enhancement. Retention and drainage aids are typically added close to the forming section of a paper machine, most often when the pulp stock is at its most dilute level, known as the thin stock. The microfibrillated cellulose and coadditive are added in a ratio of microfibrillated cellulose to coadditive of from 1:10 to 10:1, more preferably of from 1:5 to 5:1, most preferably of from 1:5 to 2:1.

The total amount of polymer (coadditive(s) plus microfibrillated cellulose) added to the paper machine is in the range of from 0.025% to 0.5%, more preferably of from 0.025% to 0.3% by weight based on the weight of the dry pulp.

The present invention is sensitive to varying pulp furnish type and quality. One skilled in the art knows that a typical furnish for alkaline free sheet used for a printing and writing applications usually possesses relatively little anionic charge when compared to recycled furnish used for a packaging paper product. The alkaline free sheet furnish contains fibers with few contaminants such as anionic trash, lignin, stickies etc. which commonly possess an anionic charge, while the recycled furnish usually contains significant amounts of these same contaminants. Therefore, a recycled furnish can accommodate greater amounts of cationic additives to enhance the performance of the papermaking process and the paper product itself relative to the alkaline free sheet furnish. Thus, the most useful embodiment of this invention may depend on such critical factors of papermaking as furnish quality and final product.

Without wishing to be bound by theory, a dual-component system consisting of microfibrillated cellulose and using coadditives such as anionically-charged inorganic microparticles such as silica or bentonite with only small amounts, or in the absence of cationic coadditives, may be preferred in applications with a pulp furnish with little anionic charge. Conversely, a dual-component system consisting of microfibrillated cellulose and cationically-charged coadditives such as cationic aqueous dispersion-type polymers or vinylamine-containing polymers, with or without additional coadditives such as colloidal silica or bentonite, may be preferred in applications with a pulp furnish with greater anionic charge.

EXAMPLES

The term actives defines the amount of solids in the composition being used. For example Hercobond™ 6350 (12.7% actives) strength aid is a vinylamine-containing polymer where the composition contains 12.7% vinylamine-containing polymer.

A method for evaluation of the performance of the drainage process is the vacuum drainage test (VDT). The device setup is similar to the Buchner funnel test as described in various filtration reference books, for example see Perry's Chemical Engineers' Handbook, 7th edition, (McGraw-Hill, New York, 1999) pp. 18-78. The VDT consists of a 300-ml magnetic Gelman filter funnel, a 250-ml graduated cylinder, a quick disconnect, a water trap, and a vacuum pump with a vacuum gauge and regulator. The VDT test was conducted by first setting the vacuum to 10 inches Hg, and placing the funnel properly on the cylinder. Next, 250 g of 0.5 wt. % paper stock was charged into a beaker and then the required additives according to treatment program (e.g., starch, vinylamine-containing polymer, acrylamide-containing polymer, flocculants) were added to the stock under the agitation provided by an overhead mixer. The stock was then poured into the filter funnel and the vacuum pump was turned on while simultaneously starting a stopwatch. The drainage efficacy is reported as the time required to obtain 230 mL of filtrate. According to the parameters of the test, lower drainage times indicate better drainage performance. These raw data were normalized to drainage performance without the additives (i.e. "untreated") using the following relationship: $100*(1+((t_{untreated}-t_{treated})/t_{untreated})$ wherein $t_{untreated}$ represents the drainage time of a system without the additives of interest, and $t_{treated}$ represents the drainage time of a system with the additives of interest. As such, $t_{untreated}$ always has a score of 100 regardless of its drainage time, and a system with a score greater than 100 indicates improved drainage performance, and a score below 100 indicates decreased drainage performance relative to the untreated benchmark.

Pulp for the drainage studies varied depending on the papermaking systems that were being modeled. Furnish A is a blend of 70:30 hardwood bleached Kraft pulp:softwood bleached Kraft pulp refined to 400 Canadian Standard Freeness (CSF). Furnish B is recycled medium pulp refined to 400 CSF.

Chemicals for the drainage studies are as indicated below. Chemicals were added on an active solids basis relative to dry pulp. PerForm™ PC8713 (100% actives) drainage aid is available from Solenis LLC (Wilmington, Del.). PerForm' PC8138 drainage aid is available from Solenis LLC (Wilmington, Del.). PerForm™ PM9025 drainage aid is colloidal silica available from Solenis LLC (Wilmington, Del.). Bentonite H is bentonite available from Byk/Khemie (Besel, Germany). CMC7MT is fully water soluble carboxymethylcellulose available from Ashland Specialty Ingredients (100% actives). Hercobond™ 6350 (12.7% actives) strength aid is a vinylamine-containing polymer available from Solenis LLC (Wilmington, Del.). StaLok 400 (100% actives) is available from Tate and Lyle (London, UK). Additive A (1% actives) is a slurry of microfibrillated cellulose with a DS of between 0.10 and 0.30 that was fibrillated (except where indicated) by passing once through a microfluidizer. Additive B (40% actives) is a cationic acrylamide-containing dispersion polymer with a reduced specific viscosity of between 5.0 and 12.0.

Example 1

Table 1 shows the drainage testing using Furnish A. StaLok 400 (0.05%), aluminum sulfate (0.025%) and PerForm™ PC 8138 drainage aid (0.02% on an actives basis versus dry pulp) were added to all entries before the other additives.

TABLE 1

Drainage Performance of Microfibrillated Cellulose with Inorganic Microparticles

| Entry | Additive A (%) | Bentonite H (%) | PerForm ™ PM 9025 (%) | Drainage Performance (%) |
|---|---|---|---|---|
| 1 | — | — | — | 100.0 |
| 2 | 0.02 | — | — | 130.8 |
| 3 | 0.04 | — | — | 134.6 |
| 4 | — | 0.08 | — | 125.0 |
| 5 | — | 0.16 | — | 139.4 |
| 6 | 0.04 | 0.08 | — | 149.2 |
| 7 | 0.04[a] | 0.08[a] | — | 149.0 |
| 8 | 0.04[b] | 0.08[b] | — | 141.0 |
| 9 | — | — | 0.02 | 103.2 |
| 10 | — | — | 0.04 | 122.6 |
| 11 | 0.04 | — | 0.02 | 133.2 |
| 12 | 0.04 [a] | — | 0.02 [a] | 136.0 |
| 13 | 0.04 [b] | — | 0.02 [b] | 143.6 |

[a]Denotes that additives were sheared together and added as one product to the pulp slurry.
[b]Denotes that Additive A was sheared separately from the microparticle, but that the two were subsequently blended together prior to addition to the pulp slurry Table 1 indicates that the addition of Additive A in concert with either bentonite or silica gives greater drainage performance than can be achieved by simply increasing the dosage of the inorganic microparticle (compare Entry 6 with Entry 5, or Entry 11 with Entry 10). This table also indicates unanticipated effects of blending Additive A with the inorganic particle. Entries 6-8 were expected to show identical drainage performance, as were Entries 11-13.

Comparative Example 2

Table 2 shows drainage testing using Furnish B. Aluminum sulfate (0.5% on an actives basis versus dry pulp) was added prior to the additives of interest. PerForm™ PC 8713 (0.0125% on an actives basis versus dry pulp) was added to all entries after the additives of interest. CMC7MT is a fully soluble (i.e. not microfibrillated) anionically derivatized cellulose of roughly equal molecular weight when compared to Additive A.

TABLE 2

Drainage Performance of MF-C with Cationic Dispersion Polymer and Comparison to Performance with Fully Soluble CMC

| Entry | Additive #1 | (%) | Additive #2 | (%) | Drainage Performance (%) |
|---|---|---|---|---|---|
| 1 | — | — | — | — | 100.0 |
| 2 | Additive B | 0.1 | — | — | 148.7 |
| 3 | Additive B | 0.2 | — | — | 139.4 |
| 4 | — | — | Additive A | 0.1 | 134.8 |
| 5 | — | — | Additive A | 0.2 | 139.7 |
| 6 | Additive B | 0.1 | Additive A | 0.1 | 162.9 |
| 7 | Additive B | 0.2 | Additive A | 0.2 | 175.9 |
| 8 | — | — | CMC7MT | 0.1 | 83.3 |
| 9 | — | — | CMC7MT | 0.2 | 69.4 |
| 10 | Additive B | 0.1 | CMC7MT | 0.1 | 97.4 |
| 11 | Additive B | 0.2 | CMC7MT | 0.2 | 110.2 |

Table 2 illustrates that the microparticle nature of the CMC is a critical factor for good drainage performance, as the fully soluble CMC7MT gives markedly worse performance, whether added alone or with a cationic dispersion-type polymer. Without wishing to be bound by theory, this suggests that the effectiveness of the polymers is not based on a coacervate mechanism alone. Also, it is observed that the two-component system of microfibrillated cellulose with cationic dispersion-polymer is much more effective than simply an increased dose of either component alone (compare Entry 6 with Entry 3 or 5).

Example 3

Table 3 shows drainage testing using Furnish B. Aluminum sulfate (0.5% on an actives basis versus dry pulp) was added prior to the additives of interest. PerForm™ PC 8713 drainage aid (0.0125% on an actives basis versus dry pulp) was added to all entries after the additives of interest.

TABLE 3

Synergistic behavior of the dual-component system

| Entry | Dosage of Additive B (%) | Dosage of Additive A (%) | Total Polymer Dosage (%) | Drainage Performance (%) |
|---|---|---|---|---|
| 1 | — | — | — | 100.0 |
| 2 | 0.20 | — | 0.20 | 149.4 |
| 3 | 0.15 | 0.05 | 0.20 | 168.0 |
| 4 | 0.10 | 0.10 | 0.20 | 167.7 |
| 5 | 0.05 | 0.15 | 0.20 | 153.4 |
| 6 | — | 0.20 | 0.20 | 135.5 |

Table 3 illustrates the synergistic nature of the microfibrillated cellulose/cationic dispersion-type polymer system, in that when added on equal amounts of active polymer, the coadditive system performs better than either single-component system.

Example 4

Table 4 shows drainage testing using Furnish B. Aluminum sulfate (0.5% on an actives basis versus dry pulp) was added prior to the additives of interest. PerForm™ PC 8713 drainage aid (0.0125% on an actives basis versus dry pulp) was added to all entries after the additives of interest.

TABLE 4

Relative Effectiveness of Dual-Component Systems for Enhancing Drainage

| Entry | Additive #1 | (%) | Additive #2 | (%) | Drainage Performance (%) |
|---|---|---|---|---|---|
| 1 | — | — | — | — | 100.0 |
| 2 | Additive B | 0.100 | — | — | 138.5 |
| 3 | Additive B | 0.075 | Additive A | 0.025 | 138.3 |
| 4 | Additive B | 0.050 | Additive A | 0.050 | 143.5 |
| 5 | Additive B | 0.025 | Additive A | 0.075 | 137.5 |
| 6 | — | — | Additive A | 0.100 | 131.3 |
| 7 | Additive B | 0.200 | — | — | 130.1 |
| 8 | Additive B | 0.150 | Additive A | 0.050 | 152.7 |
| 9 | Additive B | 0.100 | Additive A | 0.100 | 152.9 |
| 10 | Additive B | 0.050 | Additive A | 0.150 | 152.7 |
| 11 | — | — | Additive A | 0.200 | 136.7 |
| 12 | Hercobond 6350 | 0.100 | — | — | 124.4 |
| 13 | Hercobond 6350 | 0.075 | Additive A | 0.025 | 130.7 |
| 14 | Hercobond 6350 | 0.050 | Additive A | 0.050 | 131.9 |
| 15 | Hercobond 6350 | 0.025 | Additive A | 0.075 | 127.5 |
| 16 | — | — | Additive A | 0.100 | 129.5 |
| 17 | Hercobond 6350 | 0.200 | — | — | 144.9 |
| 18 | Hercobond 6350 | 0.150 | Additive A | 0.050 | 148.5 |
| 19 | Hercobond 6350 | 0.100 | Additive A | 0.100 | 145.5 |
| 20 | Hercobond 6350 | 0.050 | Additive A | 0.150 | 139.9 |
| 21 | — | — | Additive A | 0.200 | 134.7 |

Table 4 depicts that either Additive B (a cationic aqueous dispersion-type polymer) or Hercobond™ 6350 (a vinylamine-containing polymer) strength aid can be used as a coadditive in conjunction with microfibrillated cellulose, and that both systems show a positive synergy (i.e. the combined system performs superior to either component alone when compared at equal dosage). The system using Additive B in these tests shows greater synergy than the system using the vinylamine-containing polymer, which is unanticipated as we expected both systems to perform the same. These data also show that the total dosage of the system plays a role in the synergy of the system, as the higher overall dosage of the system using Additive B (Entries 7-11) achieves greater synergistic performance than the lower overall dosage of the same system (Entries 2-6).

Comparative Example 5

Table 5 shows drainage testing using Furnish B. Aluminum sulfate (0.5% on an actives basis versus dry pulp) was added prior to the additives of interest. PerForm™ PC 8713 drainage aid (0.0125% on an actives basis versus dry pulp) was added to all entries after the additives of interest.

TABLE 5

Relative Effectiveness of Dual-Component Systems for Enhancing Drainage

| Entry | Additive #1 | (%) | Additive #2 | (%) | Drainage Performance (%) |
|---|---|---|---|---|---|
| 1 | — | — | — | — | 100.0 |
| 2 | Additive B | 0.100 | — | — | 138.5 |
| 3 | Additive B | 0.075 | Additive A | 0.025 | 138.3 |
| 4 | Additive B | 0.050 | Additive A | 0.050 | 143.5 |
| 5 | Additive B | 0.025 | Additive A | 0.075 | 137.5 |
| 6 | — | — | Additive A | 0.100 | 131.3 |

TABLE 5-continued

Relative Effectiveness of Dual-Component Systems for Enhancing Drainage

| Entry | Additive #1 | (%) | Additive #2 | (%) | Drainage Performance (%) |
|---|---|---|---|---|---|
| 7 | Hercobond 6350 | 0.100 | — | — | 126.5 |
| 8 | Hercobond 6350 | 0.075 | Additive B | 0.025 | 133.3 |
| 9 | Hercobond 6350 | 0.050 | Additive B | 0.050 | 138.3 |
| 10 | Hercobond 6350 | 0.025 | Additive B | 0.075 | 138.3 |
| 11 | — | — | Additive B | 0.100 | 138.5 |

Table 5 shows the relative performance of two systems: A combination of Additive B and Additive A represents one embodiment of the present invention, while a combination of Hercobond™ 6350 and Additive B represents one embodiment of the prior art, found in US 2011/0155339. The system employing the present invention shows greater positive synergy and overall drainage performance.

Example 6

Table 6 shows drainage testing using Furnish B. Entries 1-6 were performed similar to Examples 2-5, using a low dosage of PerForm' PC8713 as a standard component, but no aluminum sulfate was added. Entries 7-8 use inorganic microparticle bentonite in place of the flocculant.

TABLE 6

Increased Drainage Performance with Three-Component System

| Entry | Additive #1 | (%) | Additive #2 | (%) | Additive #3 | (%) | Drainage Performance (%) |
|---|---|---|---|---|---|---|---|
| 1 | — | — | — | — | PerForm PC8713 | 0.0125 | 100.0 |
| 2 | Additive B | 0.150 | — | — | PerForm PC8713 | 0.0125 | 137.7 |
| 3 | Additive B | 0.125 | Additive A | 0.025 | PerForm PC8713 | 0.0125 | 143.4 |
| 4 | Additive B | 0.075 | Additive A | 0.050 | PerForm PC8713 | 0.0125 | 142.9 |
| 5 | Additive B | 0.025 | Additive A | 0.075 | PerForm PC8713 | 0.0125 | 125.8 |
| 6 | — | — | Additive A | 0.100 | PerForm PC8713 | 0.0125 | 112.7 |
| 7 | Additive B | 0.100 | Additive A | 0.050 | Bentonite H | 0.1500 | 163.4 |
| 8 | Additive B | 0.100 | Additive A | 0.050 | Bentonite H | 0.3000 | 168.0 |

Table 6 indicates that the use of a three-component system can achieve significantly greater performance than that available with the two-component system.

The invention claimed is:

1. A process for the production of paper, board, and cardboard comprising adding to a wet end of a paper machine (a) microfibrillated cellulose, wherein the microfibrillated cellulose is derived from carboxylate-substituted cellulose with a net ionic charge having an anionic degree of substitution of 0.10 to 0.30; and (b) at least one coadditive, wherein the coadditive is selected from the group consisting of at least one of (1) an acrylamide-containing, cationic aqueous dispersion polymer having a molecular weight from 100,000 D to 500,000 D, a cationic monomer charge of 20% to 40%, and a reduced specific viscosity of from 5.0 to 12.0 dL/g and (2) vinylamine-containing polymers chosen from N-vinylformamide homopolymers that have been partially hydrolyzed to vinylamine and having an N-vinylformamide charge from at least 75% to 100% and a hydrolysis from 30% to 75%, in an amount effective to improve drainage, wherein the ratio by weight of the microfibrillated cellulose to the coadditive is from 1:5 to 5:1, and wherein the total combined amount of microfibrillated cellulose and coadditive added to the wet end of the paper machine is from 0.025% to 0.3% by weight on the basis of combined total solids of microfibrillated cellulose and coadditive with respect to the weight of dry pulp; and (c) aluminum sulfate in an amount of 0.025% to 0.5% by weight with respect to the weight of dry pulp.

2. The process of claim 1 wherein the net anionic charge is generated by directly oxidizing the cellulose with an N-oxide.

3. The process of claim 1 wherein the net anionic charge is generated by reaction of the cellulose with at least one derivitizing agent.

4. The process of claim 3 wherein the derivitizing agent is selected from the group consisting of chloroacetic acid, dichloroacetic acid, bromoacetic acid, dibromoacetic acid, salts thereof, and combination thereof.

5. The process of claim 1, wherein the coadditive comprises the vinylamine containing polymer, wherein the vinylamine-containing polymer has a molecular weight of from 75,000 Daltons to 750,000 Daltons.

6. The process of claim 5, wherein the vinylamine-containing polymer has a molecular weight of from 100,000 Daltons to 600,000 Daltons.

7. The process of claim 1, wherein the coadditive comprises the cationic aqueous dispersion polymer.

8. The process of claim 7 wherein the cationic aqueous dispersion polymer is composed of two polymers (1) a cationic dispersant polymer with a molecular weight of from 10,000 to 150,000 Daltons, and (2) a cationic polymer of higher molecular weight which forms a discrete particle phase.

9. The process of claim 7, wherein the coadditive further comprises bentonite clay.

10. The process of claim 7, wherein the coadditive further comprises colloidal silica.

11. The process of claim 1, where the ratio of the microfibrillated cellulose to the combined total amount of coadditives added to the wet end of the paper machine is from 1:5 to 2:1.

* * * * *